US006944912B1

(12) United States Patent
LeBeau et al.

(10) Patent No.: US 6,944,912 B1
(45) Date of Patent: Sep. 20, 2005

(54) LATCHING HINGE MASKING DEVICE

(76) Inventors: Rodrique R. LeBeau, 9801 Hilltop Dr., St. Louis, MO (US) 63127; Gerald J. LeBeau, 9801 Hilltop Dr., St. Louis, MO (US) 63127

( * ) Notice: Subject to any disclaimer, the term of this patent is extended or adjusted under 35 U.S.C. 154(b) by 101 days.

(21) Appl. No.: 10/635,980

(22) Filed: Aug. 7, 2003

Related U.S. Application Data

(60) Provisional application No. 60/402,500, filed on Aug. 9, 2002.

(51) Int. Cl.[7] ..... E05D 11/00
(52) U.S. Cl. ..... 16/250; 118/504
(58) Field of Search ..... 16/250, 251, DIG. 2; 118/504, 505, 301; 427/282, 272

(56) References Cited

U.S. PATENT DOCUMENTS

| | | | | | |
|---|---|---|---|---|---|
| 3,912,140 | A * | 10/1975 | Franges | 294/166 |
| 3,961,602 | A | 6/1976 | Dresser | |
| 4,195,590 | A * | 4/1980 | Herrington | 118/505 |
| 4,570,291 | A | 2/1986 | Smith et al. | |
| 4,704,987 | A * | 11/1987 | Curtze | 118/500 |
| 4,796,330 | A * | 1/1989 | Ziegler | 16/251 |
| 4,802,259 | A | 2/1989 | Geslewitz | |
| 4,921,028 | A | 5/1990 | Schwartz | |
| 5,056,191 | A | 10/1991 | Love | |
| 5,198,031 | A * | 3/1993 | Derstine | 118/505 |
| 5,224,240 | A | 7/1993 | Smith et al. | |
| 5,432,979 | A | 7/1995 | Harper | |
| D361,021 | S | 8/1995 | Harper | |
| 5,722,120 | A | 3/1998 | Bindschatel et al. | |
| 6,103,974 | A | 8/2000 | Erdfarb | |
| 6,555,169 | B2 * | 4/2003 | Lynch | 427/282 |
| 6,745,435 | B2 * | 6/2004 | Bowers | 16/250 |
| 2004/0154129 | A1 * | 8/2004 | Martinez-Munoz | 16/250 |

* cited by examiner

*Primary Examiner*—Robert J. Sandy
*Assistant Examiner*—Andre' L. Jackson
(74) *Attorney, Agent, or Firm*—Kevin L. Klug

(57) ABSTRACT

A latching hinge masking device and method of use comprising two half cavities mounted with a living hinge and a unique latching mechanism and relief portions for accommodating extending screwheads. The device latches and fits around a mounted half hinge and covers the hinge completely during painting, staining, or finishing operations of a door or doorway. The device and method of use allows for easy and convenient attachment and removal and further allows for repeated re-use of the device.

10 Claims, 7 Drawing Sheets

LATCHING HINGE MASKING DEVICE

This application claims priority of U.S. Provisional Patent Application No. 60/402,500, filed Aug. 9, 2002.

BACKGROUND OF THE INVENTION

The art of the present invention relates to paint masking devices in general and more particularly to an improved and modified hinge masking device which is utilized to cover hinges on doors and doorways during painting, coating, or finishing of the aforesaid. The device and method of use represents an improvement over the prior art by providing a unique latching mechanism and one or more relief portions for screw heads which are extended from the covered hinge.

During the process of painting a door with attached hinges, it is necessary to mask or cover the hinges to prevent paint from attaching to the hinges. When the hinge pin is removed from the hinge and the door removed from the jamb or mounting, there are two hinge plates or hinge halves present which must be covered prior to painting. The present invention represents a masking device and the method for use to cover a hinge half attached to a door or door frame while the surrounding areas are being coated with paint or other surface preparations. The device and its method of use is not affected by extended hinge screw heads.

During painting, staining, waxing and similar finishing operations to doors and door frames, it is commonly desired to prevent these coatings from coming in contact with the exposed areas of the hinge halves. It is often required to either shield the hinge halves or remove them entirely until the finishing operations are complete. One method practiced is to remove the door from its frame and to use masking tape and a sharp knife to trim the tape close to the exposed area of each hinge half. This basic technique with variations is shown and described in U.S. Pat. No. 5,722,120 issued Mar. 3, 1998 to Bindschatel, et al., titled: Pre-Stamped Half-Hinge Adherent Cover, U.S. Pat. No. 4,921,028 issued Mar. 1, 1990 to Schwartz, titled: Door Hardware Cover, U.S. Pat. No. 3,961,602 issued Jun. 8, 1976 to Dresser, titled: Butt Covers, U.S. Pat. No. 4,796,330 issued Jan. 10, 1989 to Ziegler, titled Hinge Mask, and U.S. Pat. No. 5,056,191 issued Oct. 15, 1991 to Love, titled: Butt Hinge Paint Mask and Masking Method.

Another prior art method is to remove the door from its frame and then remove the hinge fasteners and the hinge halves completely from the door and door frame area. This old method then requires reinstalling the hinge halves after the finishing operations are completed. Both of the aforesaid methods are objectionable because of the resultant low productivity. Often residual glue or adhesive left over from the taping operation requires a solvent wiping step to completely remove this residue from the exposed areas of the hinge halves. Removing and reinstalling hinge halves adds to the risk of damaging the newly finished door and door frames due to the amount of additional handling and tool usage required to perform the task. Further, hinges that are completely removed and reinstalled later run the risk of mix ups in hinge placement which could prevent proper operation when articulating the door.

The present art hinge masking device is a one piece molded device which is self adhering to a hinge half without the use of adhesives, adhesive tapes, fasteners or external clamping devices. It serves as a protective mask which shields the normally exposed area of the hinge half during door and door frame finishing operations. The device has a unique latching mechanism and one or more relief portions for screw heads which are extended from the covered hinge.

The present art invention is preferably of a one piece construction. The pre-molded shape of the protector allows for an easy snap in place application or removal of the device with its unique latching mechanism. It covers or encases the normally exposed hinge areas and shields them against coatings which are applied to the door and door frame areas as part of its finishing. In its preferred form, the device is molded from a synthetic plastic resin which can be either of the rigid or semi-rigid type and reused.

Prior art pre-molded devices such as disclosed in U.S. Pat. No. 5,224,240 issued Jul. 6, 1993 to Smith et al. titled: Hinge Masking Device and Method, U.S. Pat. No. 5,432,979 issued Jul. 18, 1995 to Harper, titled: Door Hardware Paint Shield, and U.S. Pat. No. 4,195,590 issued Apr. 1, 1980 to Herrington, titled Door Casing Hardware Paint Shield fail to offer the combination of the unique positive latching mechanism and convenience of use which the present art offers. For example, Smith et al. provides a one piece pre-molded device but does not provide the positive latching or screw head relief which the present art provides. Harper describes a one piece pre-molded mask which slides over the hinge but must be broken for removal. Herrington describes a one piece pre-molded shield which slides over the hinge but does not fully cover the hinge or allow for easy removal. None of the aforesaid prior art devices allow for positive placement and reliable and convenient re-use of the device.

Accordingly, an object of the present invention is to provide a device and method for mask protecting a door or door frame hinge half even if the hinge half has screw heads which are extended above the level of the hinge.

Another object of the invention is to provide a device which can be quickly installed without the use of adhesives, fasteners, tape or clamps and which has a quick and secure locking mechanism.

Another object of the invention is to provide a device that can be quickly removed from the hinge half without the use of tools, and is easily and reliably reusable many times over.

A further object of the present invention is to provide a masking device of one piece construction.

A still further object of the invention is to provide an inexpensive covering device for premounted door and door frame half hinges during painting, staining, and similar operations.

Another further object of the invention is to provide a one piece part which is capable of being used on either the door half hinge, or the door frame half hinge to shield the exposed areas of the mounted half hinge.

SUMMARY OF THE INVENTION

To accomplish the foregoing and other objects of this invention there is provided a device and method for mask protecting a door or door frame hinge half. The apparatus and method is especially suited for repeated and secure covering of exposed hinge halves during painting, staining, and finishing operations.

The device is provided with two rigid half cylindrical cavities, a first cavity and a second cavity together forming a complete cavity, connected via a thin membrane area or what is commonly accepted as a living hinge. At the ends of the first cavity are end closure walls having one or more extending lips which latch over and with a large panel or long flat area attached to the second cavity. The first cavity also has a somewhat smaller or short flat area, between and connecting the end closure walls.

When the device is folded along the membrane or living hinge area the two cavity areas form a shield or cylinder around the hinge barrel. As the two cavities come together, the extending lips on the end closure walls slide over the large panel via the elastic bending of said end closure walls. The elastic return to position of said extending lips holds the first cavity to the second cavity and keeps the device in place. Once the extending lips are positioned over said large panel the entire exposed hinge half is covered. This includes both sides of the hinge plate, its edges, the hinge barrel, and its edges. By grasping the long flat area and pulling away from the short flat area the device can be easily removed. Preferably the end closure walls are flexed away from said cavities to make removal easier.

The large panel or long flat area attached to the second cavity contains one or more relief portions for screw heads which are not flush with the hinge. That is, often the screws which hold a hinge do not have heads which are flush with the hinge plate itself. This phenomena is often caused by sloppy workmanship or misaligned screw holes. Prior art hinge covering devices have not addressed this problem. If the screw heads cause the large panel or long flat area to not sit flush with the hinge plate, when painted the hinge plate will have paint leak onto it. In its preferred form, the present art utilizes three relief portions of circular cross section and approximately 1/16 inch deep, one for each screw head of a conventional hinge. The relief portions are aligned in a pattern which covers the hinge screw heads. Alternative embodiments may utilize one relief portion or a plurality of relief portions of any shape or depth on said large panel which correspond to the placement of screw heads in the hinge plate.

Although preferably molded from a one piece polymer material such as a high density polyester, the device may be manufactured from a variety of materials, including but not limited to wood, metals, composites, papers, and cloths.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
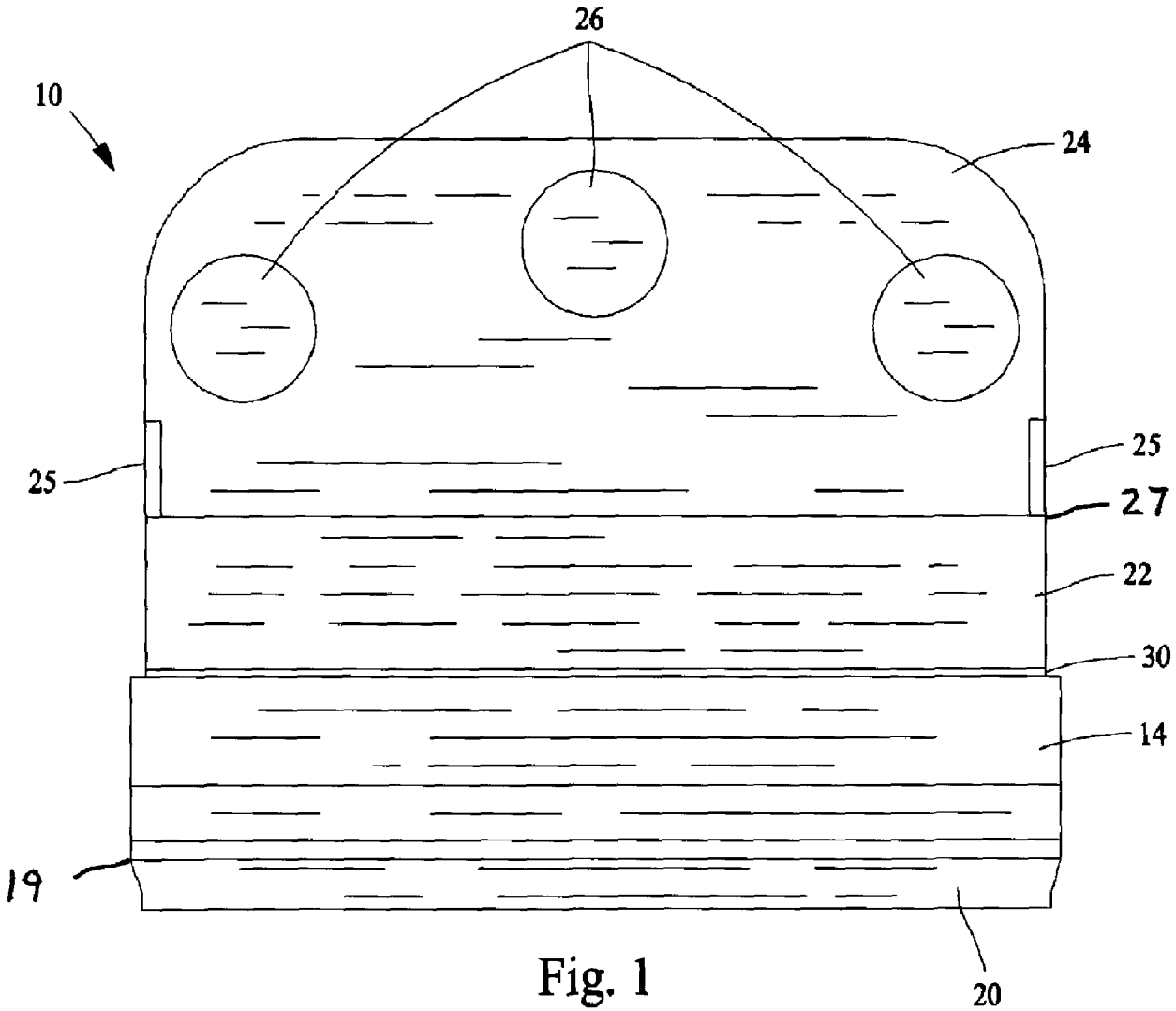
FIG. 1 is a top plan view of a latching hinge masking device of the present invention in an open position.
Figure 2:
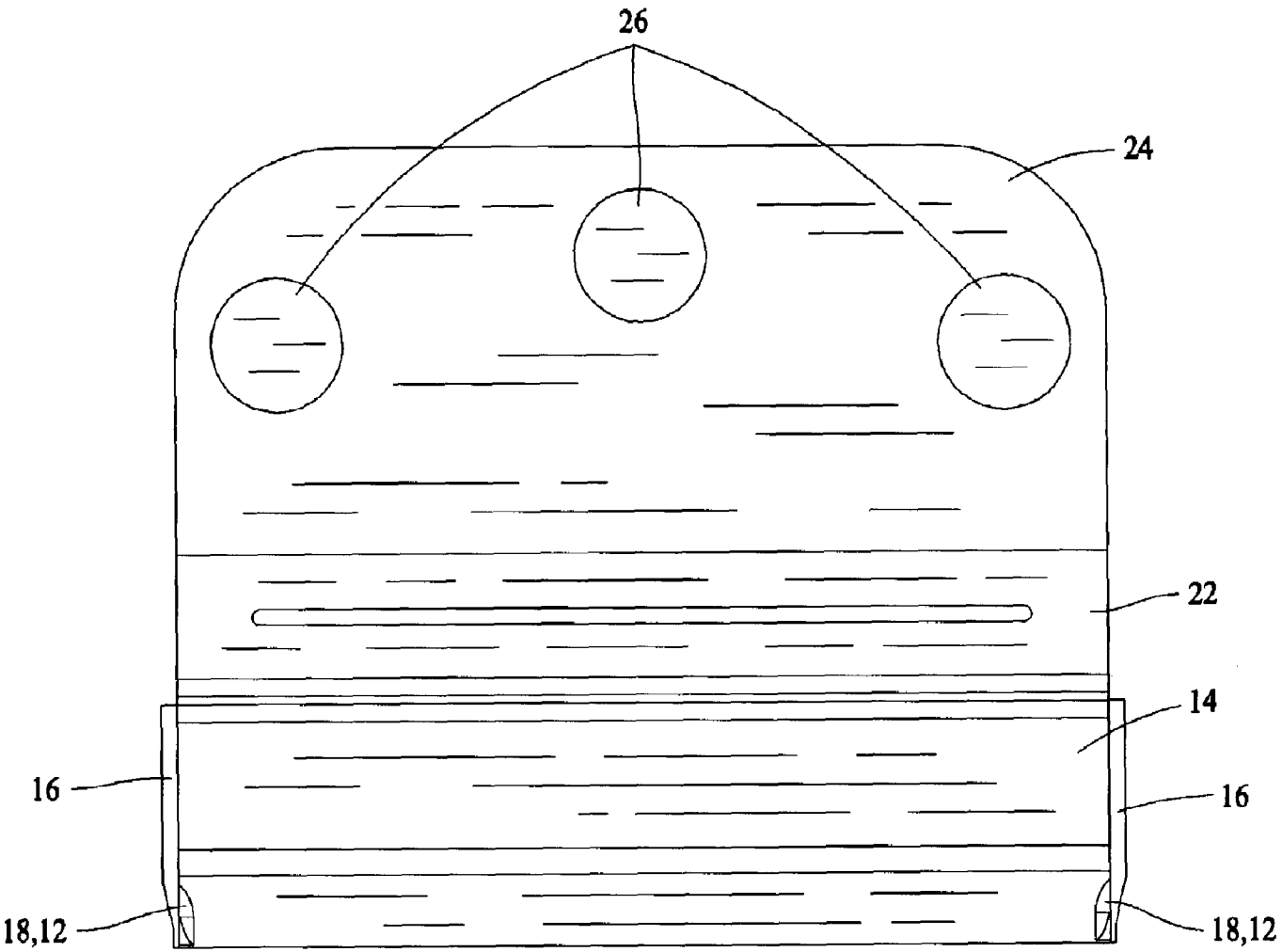
FIG. 2 is bottom plan view of a latching hinge masking device of the present invention in an open position.
Figure 3:
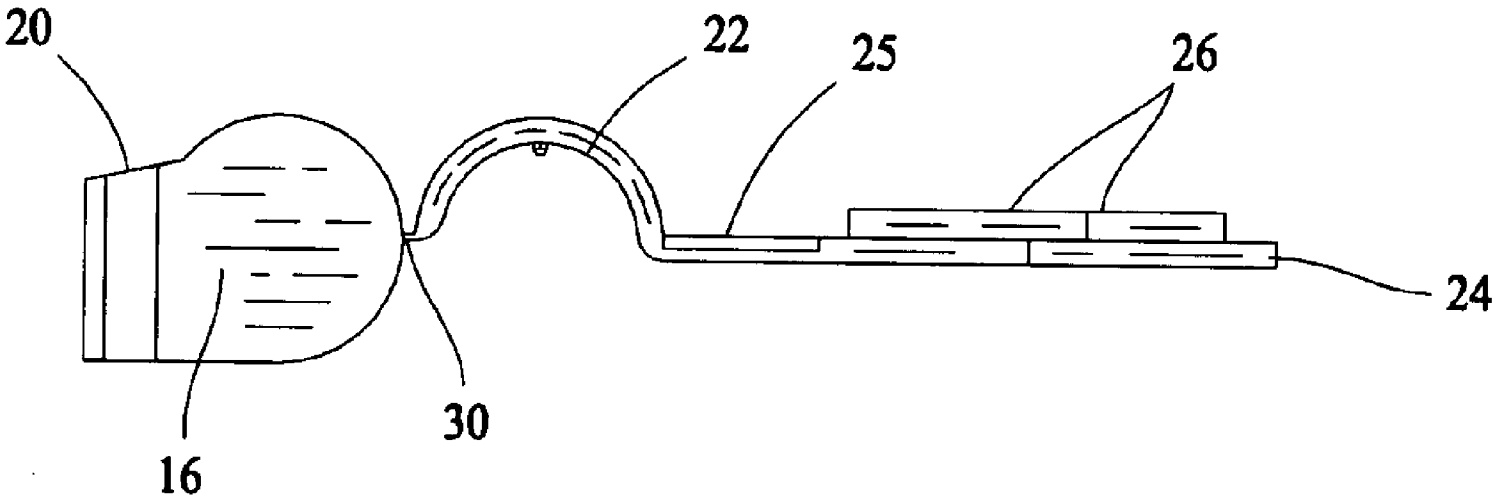
FIG. 3 is a left side plan view of a latching hinge masking device of the present invention in an open position which is symmetrical with a right side plan view.
Figure 4:
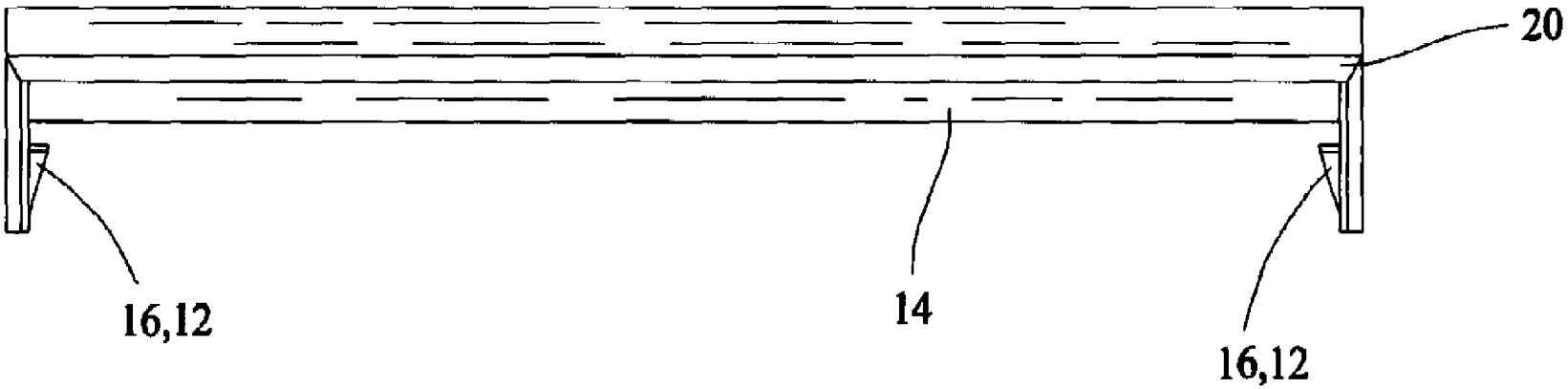
FIG. 4 is a back side plan view of a latching hinge masking device of the present invention in an open position.
Figure 5:
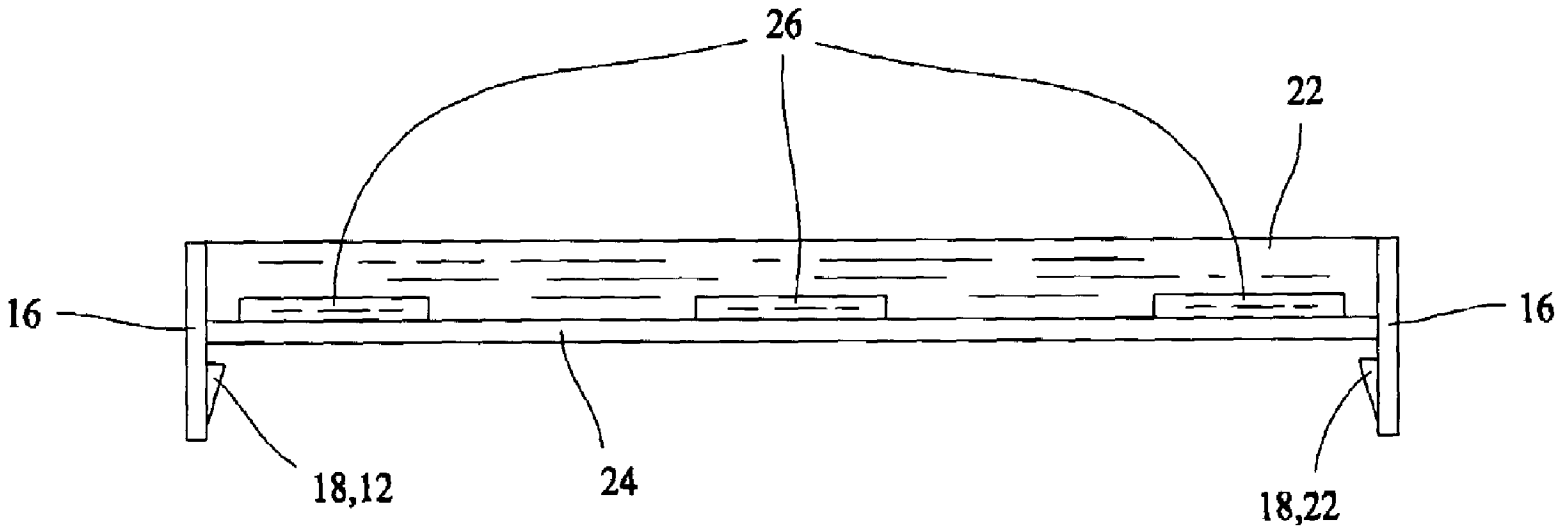
FIG. 5 is a front side plan view of a latching hinge masking device of the present invention in an open position.
Figure 6:
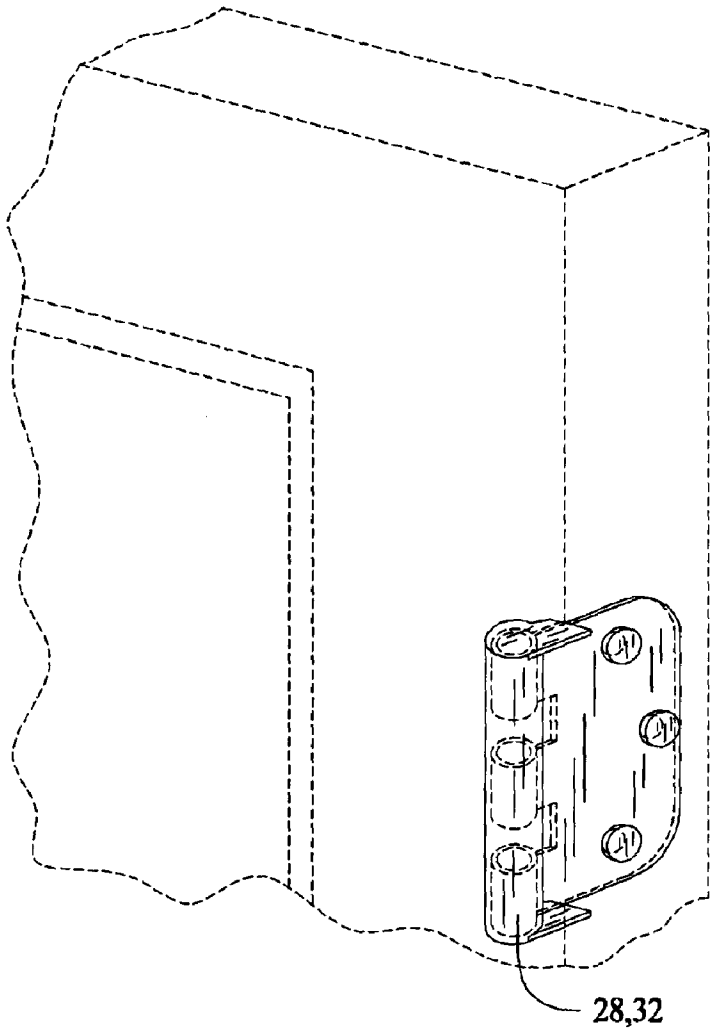
FIG. 6 is a perspective view of a latching hinge masking device of the present invention placed upon a door half hinge in a closed position.
Figure 7:
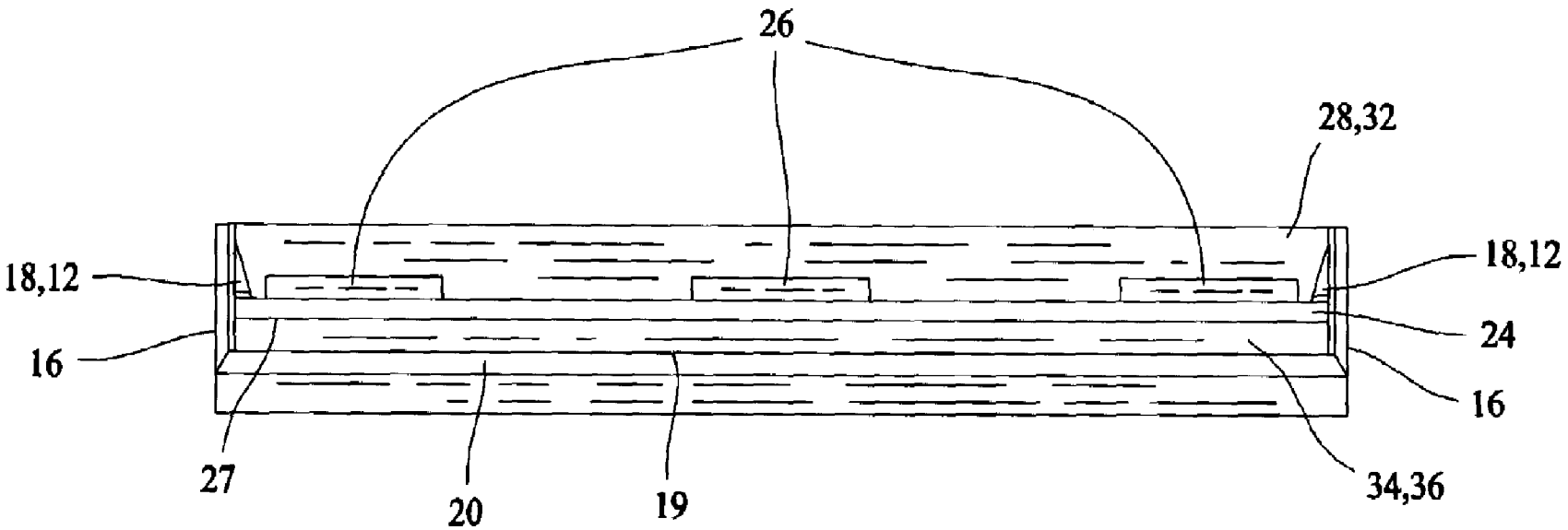
FIG. 7 is a front side plan view of a latching hinge masking device of the present invention in a closed position.

Referring now to the drawings, there is shown in FIGS. 1–6 a preferred embodiment of a latching hinge masking device 10 having a first cavity 14, a second cavity 22 having an attached panel 24 with one or more relief portions 26, a living hinge 30, and a latching mechanism 12. The device 10 is particularly adapted for repeated covering of door hinges during painting, staining, or refinishing procedures.

The present invention represents a door hinge masking device 10 utilized for masking a half-hinge that is attached onto a surface of either a door or a door frame. The half-hinge has a portion of the barrel that projects outwardly from the surface and an integral hinge plate with a thickness embedded in the surface leaving exposed a first face or outboard surface of the hinge plate and a portion of a second opposite face or inboard surface of the hinge plate. The present art device is an integral unit that includes an elongate cylindrical body 28, comprised of the first 14 and second 22 cavities, of a size and shape sufficient to enclose the barrel portion of the half-hinge.

The cylindrical body 28 of the present invention has a cylindrical wall 32 of an elongate length and two end closure walls 16. When closed, the device has a lengthwise opening 34 through a side of and substantially parallel with the cylindrical body 28. This opening 34 forms an upper lengthwise edge 19 on the first cavity 14 and a lower lengthwise edge 27 along the second cavity 22. The device further includes a first cover panel 20, i.e. smaller or short flat area, attached along the upper lengthwise edge 19, or first lengthwise edge of said first cavity 14, extending radially outwardly from the cylindrical body 28, the first cover panel 20 of a size and shape to cover the exposed portion of the second face surface of the hinge plate. The device also includes a second cover panel 24, i.e. large panel or long flat area, attached along the lower lengthwise edge 27, or first lengthwise edge of said second cavity 22, extending radially outwardly from the cylindrical body 28, the second cover panel 24 of a size and shape to cover the exposed first face surface of the hinge plate. In the preferred embodiment, there exists a space 36 or lengthwise opening 34 between the first 20 and second 24 cover panels approximately the thickness of the hinge plate when the device is latched and closed.

In the preferred embodiment, the first cavity 14 or first lengthwise half cylindrical housing is shaped to cover half of the hinge barrel, and the second cavity 22 or second lengthwise half cylindrical housing is shaped to cover a remaining half of the hinge barrel. The device further includes a hingeable membrane or living hinge 30 attached between the half cylindrical housings 14, along adjacent second lengthwise edges of said first 14 and second 22 cavities opposite said panels 20, 24.

Yet another aspect of the invention is a method to mask a half-hinge attached onto or into a surface of either a door or a door frame, the half-hinge having a portion of the barrel that projects outwardly from the surface and an integral hinge plate with a thickness inlaid in the surface leaving exposed a first face surface of the hinge plate with extending screw heads and a portion of a second opposite face surface of the hinge plate. The method includes providing one of the devices 10 described herein and utilizing the same when extending screw heads are present. The method further includes opening the device to widen the lengthwise opening 34 and engaging the elongate cylindrical body 28, i.e. first cavity 14 and second cavity 22, over the barrel portion with the cover panels 20, 24 facing their respective face surfaces of the hinge plate. The method then includes operating the closure means or latching mechanism 12 to hold the cylindrical body 28 around the barrel portion and the cover panels 20, 24 against the exposed face surfaces of the hinge plate, and then coating the surface of either the door or the door frame with a chosen surface preparation. The method then includes releasing the latching mechansim 12, and removing the device 10 from the half-hinge.

As aforesaid, in its preferred form, the device includes two cavities 14, 22, two flat areas 20, 24, two end closure walls 16, and one or more extending lips 18 which latch over and with the large panel 24 or long flat area attached to the second cavity 22. In its preferred form, the large panel 24 has notches 25 in the edges where the extending lips 18 mate. Preferably these notches 25 are tapered from the large panel 24 surface opposite that portion which mates with the hinge plate to approximately ½ of the thickness of said large panel 24. This taper allows said extending lips 18 to easily disengage from said large panel 24 when force is applied to said panel 24. This allows for easy opening of the device 10.

In its preferred form, the latching hinge masking device 10 is a one piece molded rigid thermoplastic material which has integral portions arranged so that the shapes of said portions conform to that of a standard interior half door hinge. By placing the first cavity 14 with the short flat area 20 against the inboard side of a mounted half hinge and bending it along the membrane or living hinge area 30, the first cavity portion 14 will then cover a portion of the hinge barrel area and the exposed back portion of the hinge plate. The second cavity 22 will cover the remaining portion of the hinge barrel and the second panel 24 will cover the exposed or outboard side hinge plate area, including extending screwheads. The normally exposed edges or ends of the half hinge are covered by the end walls 16 attached to the first cavity 14.

The device 10 as shown and described is used on either the premounted half hinge of a door or a door frame. The intended use is for standard prehung unfinished doors and frames used in new home construction or when refinishing doors and/or the frame moldings. The device 10 snaps in place with the extending lips 18 mounted on the end closure walls 16 latching over and with the large panel 24 or long flat area attached to the second cavity 22. Preferably an extending lip 18 is placed onto each end closure wall 16 on the cavity side of said wall 16. Alternative embodiments may utilize only one extending lip 18 on only one end closure wall 16 or use multiple extending lips 18. The ductile material, preferably thermoplastic resin, allows each end closure wall 16 to flex as the extending lip 18 slides over the large panel 24 or flat area. The natural memory of the material allows the end closure wall 16 to return to the molded or original position after sliding over the large panel 24, thereby securing the device 10 around the half hinge. The large panel area 24 is designed to cover the plate area or outboard side and shape of a standard hinge. The short flat area 20 covers the short exposed area or inboard side of a premounted hinge half. The cylindrically shaped cavities 14, 22 cover the round barrel pivot area of a hinge half and the end closure walls 16 cover the edges or ends of a hinge half which are not inlaid into a door or door frame.

Those skilled in the art will appreciate that a door hinge masking device has been shown and described. That said present art is capable of repeatedly masking half hinges while attached to a door or door frame during the painting or finishing process. The device further provides a unique latching mechanism which assures secure latching when attached and provides for easy removal and reuse when the finishing process is complete.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A latching hinge masking device comprising:

a first cavity of sufficient size to cover substantially one half of a mounted half hinge barrel, having flexible closure walls at each of a first and second end, each of said walls capable of substantially covering an end of said hinge barrel, and a first cover panel extending from a first lengthwise edge of said first cavity and of sufficient size to cover an inboard side of said half hinge; and a second cavity of sufficient size to cover substantially one half of said half hinge barrel, having a second cover panel extending from a first lengthwise edge of said second cavity and of sufficient size to cover an outboard side of said half hinge, said second cover panel having one or more relief portions of sufficient width and depth to cover screwheads extending from said outboard side; and an extending lip on each of said closure walls, each having a length, each extending substantially toward the opposite closure wall and capable of securing over said second cover panel upon flexing of said closure walls, said extending lips in conjunction with said second cover panel forming a latching mechanism; and a living hinge connected with a second lengthwise edge of said first cavity and a second lengthwise edge of said second cavity whereby said cavities may be flexed toward each other and around said half hinge barrel and said extending lips flexibly secured around and over said second cover panel thereby allowing said hinge masking device to substantially cover and latch around said half hinge.

2. A latching hinge masking device comprising:

a first cavity of sufficient size to cover substantially one half of a mounted half hinge barrel, having closure walls at each of a first and second end, each of said walls capable of substantially covering an end of said hinge barrel, and a first cover panel extending from a first lengthwise edge of said first cavity and of sufficient size to cover an inboard side of said half hinge; and a second cavity of sufficient size to cover substantially one half of said half hinge barrel, having a second cover panel extending from a first lengthwise edge of said second cavity and of sufficient size to cover an outboard side of said half hinge; and one or more extending lips having a length and attached with one or more of said closure walls and each extending substantially toward the opposite closure wall and capable of securing over said second cover panel, said extending lips in conjunction with said second cover panel forming a latching mechanism; and a living hinge connected with a second lengthwise edge of said first cavity and a second lengthwise edge of said second cavity whereby said cavities may be flexed toward each other and around said half hinge barrel and said extending lips secure around and over said second cover panel thereby allowing said hinge masking device to substantially cover and latch around said half hinge.

3. The latching hinge masking device as described in claim 2 further comprising:

one or more notches on said second cover panel located substantially where said extending lips secure around and over said second cover panel whereby said extending lips engage said notches and said notches allow for easy and convenient disengagement of said lips from said notches.

4. The latching hinge masking device as described in claim 2 further comprising:

one or more relief portions on said second cover panel of sufficient width and depth to cover one or more screwheads extending from said half hinge outboard side and yet further allow said second cover panel to sit substantially flush with said outboard side.

5. The latching hinge masking device as described in claim 4 further comprising:

one or more notches on said second cover panel located substantially where said extending lips secure around and over said second cover panel whereby said extending lips engage said notches and said notches allow for easy and convenient disengagement of said lips from said notches.

6. The latching hinge masking device as described in claim 2 whereby:

one or more of said closure walls having sufficient flexibility to flex away from said second cover panel at least as far as said length of said extending lips as said extending lips secure around and over said second cover panel and further having a sufficient material memory to return to an original position when said extending lips secure over said second cover panel.

7. The latching hinge masking device as described in claim 6 further comprising:

one or more relief portions on said second cover panel of sufficient width and depth to cover one or more screwheads extending from said half hinge outboard side and yet further allow said second cover panel to sit substantially flush with said outboard side.

8. The latching hinge masking device as described in claim 6 further comprising:

one or more notches on said second cover panel located substantially where said extending lips secure around and over said second cover panel whereby said extending lips engage said notches and said notches allow for easy and convenient disengagement of said lips from said notches.

9. A method of masking a mounted half hinge, the steps comprising:

forming a latching hinge masking device having extending lips extending from and mounted onto each of two flexible closure walls, said closure walls mounted at two ends of a first cavity having a first cover panel of substantially equivalent size to an inboard side of a mounted half hinge; and forming a second cavity attached with said first cavity with a living hinge and further having a second cover panel of substantially equivalent size to an outboard side of said mounted half hinge; and placing said first cavity around a barrel of said half hinge; and placing said first cover panel over said inboard side; and bending said second cavity on said living hinge toward said first cavity and around said barrel; and placing said second cover panel over said outboard side; and pushing said second cover panel over and into said extending lips; and flexing said closure walls away from said second cover panel as said second cover panel pushes over said extending lips whereby said extending lips may clear said second cover panel; and releasing said closure walls whereby said latching hinge masking device is latched onto said mounted half hinge; and finishing around said mounted half hinge; and flexing said closure walls away from said second cover panel as said second cover panel is pulled over said extending lips and away from said outboard side; and removing said latching hinge masking device from said half hinge.

10. The method of masking a mounted half hinge as set forth in claim 9 further comprising:

forming one or more relief portions in said second cover panel; and placing said relief portions over one or more extending screw heads on said outboard side of said of said half hinge, whereby said second cover panel sits flush with said outboard side.

* * * * *